US009200524B2

(12) United States Patent
Arai et al.

(10) Patent No.: US 9,200,524 B2
(45) Date of Patent: Dec. 1, 2015

(54) STEAM TURBINE ROTOR

(71) Applicant: Mitsubishi Hitachi Power Systems, Ltd., Kanagawa (JP)

(72) Inventors: Masahiko Arai, Hitachinaka (JP); Hiroyuki Doi, Tokai (JP); Shinji Oikawa, Hitachi (JP); Kenichi Murata, Hitachi (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 458 days.

(21) Appl. No.: 13/777,373

(22) Filed: Feb. 26, 2013

(65) Prior Publication Data

US 2013/0224033 A1 Aug. 29, 2013

(30) Foreign Application Priority Data

Feb. 27, 2012 (JP) ..... 2012-039523
Jan. 17, 2013 (JP) ..... 2013-005880

(51) Int. Cl.
*F01D 5/28* (2006.01)

(52) U.S. Cl.
CPC ..... *F01D 5/28* (2013.01); *F05D 2220/31* (2013.01)

(58) Field of Classification Search
CPC ..... F01D 5/28; F01D 2220/31
USPC ..... 415/200; 416/241 R
See application file for complete search history.

(56) References Cited

U.S. PATENT DOCUMENTS

| | | | | |
|---|---|---|---|---|
| 3,556,776 | A | 1/1971 | Clarke, Jr. et al. | |
| 9,062,362 | B2 * | 6/2015 | Oikawa et al. | 1/1 |
| 2006/0127216 | A1 | 6/2006 | Suga et al. | |

FOREIGN PATENT DOCUMENTS

| | | | |
|---|---|---|---|
| CN | 1789670 | A | 6/2006 |
| EP | 0 237 170 | B1 | 5/1994 |
| JP | 62-180040 | A | 8/1987 |
| JP | 4702267 | B2 | 6/2011 |
| WO | WO 2012/002208 | A1 | 1/2012 |

OTHER PUBLICATIONS

Chinese Office Action dated Apr. 20, 2015 with partial English translation (12 pages).
Chinese Office Action dated Sep. 4, 2014 with partial English translation (12 pages).

* cited by examiner

*Primary Examiner* — Ching Chang
(74) *Attorney, Agent, or Firm* — Crowell & Moring LLP

(57) ABSTRACT

There is provided a steam turbine rotor with high reliability and corresponding to increase in length of a high strength steel blade, in which only a low-pressure last stage is highly strengthened. The steam turbine rotor includes a steam turbine low-pressure last stage long blade made of a precipitation hardening type martensitic stainless steel containing, in mass, 0.1% or less of C, 0.1% or less of N, 9.0% to 14.0% inclusive of Cr, 9.0% to 14.0% inclusive of Ni, 0.5% to 2.5% inclusive of Mo, 0.5% or less of Si, 1.0% or less of Mn, 0.25% to 1.75% inclusive of Ti, 0.25% to 1.75% inclusive of Al, and the balance consisting of Fe and inevitable impurities, and a disk having a specific alloy composition is joined to a last stage section of the turbine rotor made of a low-alloy steel.

7 Claims, 2 Drawing Sheets

SECTIONAL VIEW OF LOW-PRESSURE STEAM TURBINE

LOW-PRESSURE TURBINE ROTOR

HIGH PRESSURE-LOW PRESSURE COMBINED TURBINE ROTOR

SECTIONAL VIEW OF LOW-PRESSURE STEAM TURBINE

STEAM TURBINE ROTOR

BACKGROUND OF THE INVENTION (1) Field of the Invention

The present invention relates to a low-pressure turbine rotor, and to a steam turbine rotor with a large power generation capacity suitable for a large thermal power generation turbine or the like.

(2) Description of the Related Art

In recent years, enhancement of the efficiency of thermal power generation plants has been desired from the viewpoint of energy saving (for example, saving of fossil fuel) and prevention of global warming (for example, reduction of the generation amount of $CO_2$ gas). One of effective means for enhancing the efficiency of steam turbines is to increase the length of last stage long blades of the steam turbines. Further, by increasing the length of the last stage long blades of the steam turbines, reduction of facility construction time period and cost reduction thereby can be also expected as secondary effects because of reduction of the number of turbine casings.

Because the long blades are used under high centrifugal stress and humid environments, the material of the long blades is required to have characteristics excellent in both strength and corrosion resistance. While rotors on which the blades are planted are also required to have high strength due to increase in size of the blades, low-pressure rotors (ASTM designation A470Class7) which are used at present are insufficient in strength. If mono-block type rotors are strengthened by heat treatment, the characteristics balance as rotors becomes worsened because the mono-block type rotors are needlessly strengthened and thus reduced in toughness except in last stages, and the sensitivity of stress-corrosion-cracking is enhanced.

BRIEF SUMMARY OF THE INVENTION

An object of the present invention is to provide a steam turbine rotor with high reliability and responding to increase in length of a high-strength steel blade, by highly strengthening a low-pressure last stage only.

The present invention provides a steam turbine rotor including: a steam turbine low-pressure last stage long blade made of a precipitation hardening type martensitic stainless steel containing, in mass, 0.1% or less of C, 0.1% or less of N, 9.0% to 14.0% inclusive of Cr, 9.0% to 14.0% inclusive of Ni, 0.5% to 2.5% inclusive of Mo, 0.5% or less of Si, 1.0% or less of Mn, 0.25% to 1.75% inclusive of Ti, 0.25% to 1.75% inclusive of Al, and the balance consisting of Fe and inevitable impurities; and a disk containing, in mass, 0.10% to 0.35% of C, 0.50% or less of Si, 0.33% or less of Mn, 8.0% to 13.0% of Cr, 0.5% to 3.5% of Ni, 1.5% to 4.0% of Mo, 0.05% to 0.35% of V, 0.02% to 0.30% in total of one kind or two kinds of Nb and Ta, 0.02% to 0.15% of N, and the balance consisting of Fe and inevitable impurities, wherein the disk is joined to a final stage section of the turbine rotor made of a low-alloy steel.

According to the present invention, a steam turbine with high efficiency and a large capacity can be manufactured, and highly efficient power generation can be achieved, so that saving of fossil fuel and suppression in generation amount of emission gas are enabled, and a contribution can be made to global environmental conservation.

DETAILED DESCRIPTION OF THE INVENTION

Figure 1:
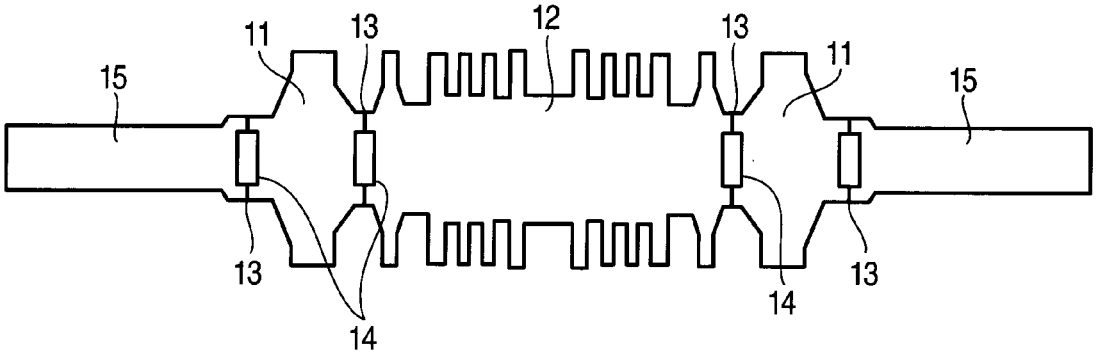
FIG. 1 is a schematic view of a block construction type low-pressure turbine rotor shaft.

Hereinafter, effects and prescription of addition amounts of component elements contained in a precipitation hardening martensitic stainless steel long blade material according to the present invention will be described.

Carbon (C) forms chromium carbide, so that reduction in toughness due to excessive precipitation of the carbide, worsening of corrosion resistance due to reduction in Cr concentration in the vicinity of a grain boundary or the like becomes a problem. Further, C significantly lowers a martensitic transformation finish point. Therefore, the amount of C needs to be reduced, and is preferably 0.1% or less, and is more preferably 0.05% or less.

Nitrogen (N) forms TiN and AlN to reduce fatigue strength, and also has an adverse effect on toughness. Further, N significantly lowers the martensitic transformation finish point. Therefore, the amount of N needs to be reduced, and is preferably 0.1% or less, and is more preferably 0.05% or less.

Chrome (Cr) is an element which contributes enhancement in corrosion resistance by forming a passive film on a surface. By setting an addition lower limit at 9.0%, the corrosion resistance can be sufficiently ensured. Meanwhile, if Cr is excessively added, δ ferrite is formed so that mechanical properties and corrosion resistance are worsened significantly, and therefore, an upper limit is set at 14.0%. For the above reasons, the addition amount of Cr needs to be set at 9.0 to 14.0%. The addition amount of Cr is desirably 11.0 to 13.0%, and is preferably 11.5 to 12.5% in particular.

Nickel (Ni) is an element which suppresses formation of δ ferrite, and contributes to enhancement in strength by precipitation hardening of Ni—Ti and Ni—Al compounds. Further, the nickel also improves a hardening property and toughness. In order to make the above described effect sufficient, an addition lower limit needs to be set at 9.0%. Meanwhile, if the addition amount exceeds 14.0%, retained austenite is formed, so that a target tensile property cannot be obtained. From the above viewpoint, the addition amount of Ni needs to be set at 9.0 to 14.0%. The addition amount of Ni is more desirably 11.0 to 12.0%, and is preferably 11.25 to 11.75% in particular.

Molybdenum (Mo) is an element which enhances corrosion resistance. In order to obtain target corrosion resistance, addition of at least 0.5% is needed, whereas if the addition amount exceeds 2.5%, formation of δ ferrite is promoted to worsen the characteristics on the contrary. From the above viewpoint, the addition amount of Mo needs to be set at 0.5 to 2.5%. The addition amount of Mo is more desirably 1.0 to 2.0%, and is preferably 1.25 to 1.75% in particular.

Silicon (Si) is a deoxidizer, and is preferably set at 0.5% or less. This is because if the silicon exceeds 0.5%, formation of δ ferrite becomes a problem. The silicon is more desirably set at 0.25% or less, and is preferably set at 0.1% or less in particular. If a vacuum carburized deoxidization method, and an electro-slag remelting method are applied, addition of Si can be omitted. In these cases, no addition of Si is preferable.

Manganese (Mn) is a deoxidizer and a desulfurizing agent, and in order to suppress formation of δ ferrite, addition of at least 0.1% or more of Mn is needed. Meanwhile, if the addition of Mn exceeds 1.0%, toughness is reduced, and therefore, 0.1 to 1.0% of Mn needs to be added. 0.3 to 0.8% of Mn is more desirable, and in particular, 0.4 to 0.7% of Mn is more preferable.

Aluminum (Al) is an element which forms an Ni—Al compound and contributes to precipitation hardening. In order to sufficiently express precipitation hardening, at least 0.25% or more of Al needs to be added. If the addition amount exceeds 1.75%, reduction of mechanical properties due to excessive precipitation of the Ni—Al compound and formation of δ ferrite is caused. From the above viewpoint, the addition amount of Al needs to be set at 0.25 to 1.75%. The addition amount of Al is more desirably 0.5 to 1.5%, and is preferably 0.75 to 1.25% in particular.

Titanium (Ti) forms an Ni—Ti compound and contributes to precipitation hardening. In order to obtain the above described effect sufficiently, an addition lower limit needs to be set at 0.25% or more. When Ti is excessively added, δ ferrite is formed, and therefore, the upper limit is set at 1.75%. Therefore, the addition amount of Ti needs to be set at 0.25 to 1.75%. The addition amount of Ti is more desirably 0.5 to 1.5%, and is preferably 0.75 to 1.25% in particular.

The addition amounts of Al and Ti need to be set at 0.75 to 2.25 inclusive in total. When the total addition amount of Al and Ti is smaller than 0.75, the precipitation hardening is not sufficient, and a target tensile strength cannot be obtained. Meanwhile, when the total addition amount is larger than 2.25, the precipitation hardening becomes excessive and toughness reduces.

Niobium (Nb) is an element which forms carbide and contributes to enhancement of strength and corrosion resistance. If the niobium is less than 0.05%, the effect thereof is insufficient, and if 0.5% or more of the niobium is added, formation of δ ferrite is promoted. From the above viewpoint, the addition amount of Nb needs to be set at 0.05 to 0.5%. The addition amount of Nb is more desirably 0.1 to 0.45%, and is preferably 0.2 to 0.3% in particular.

Further, vanadium (V) and Tantalum (Ta) also can be replaced with Nb. When two or three kinds of Nb, V and Ta are added in combination, the total of the addition amounts needs to be the same as the amount of Nb added alone. Addition of these elements is not essential, but makes precipitation hardening more remarkable.

Tungsten (W) has the effect of enhancing corrosion resistance similarly to Mo. Addition of W is not essential, but the effect can be further enhanced by addition in combination with Mo. In this case, the total of the addition amounts of Mo and W needs to be the same as the amount of Mo added alone in order to prevent precipitation of δ ferrite.

In the present invention, inevitable impurities indicate components which are contained in the present invention due to the fact that the components are originally contained in a raw material, or enter the raw material in the process of manufacture, but are not intentionally included. As the inevitable impurities, P, S, Sb, Sn and As are cited, and at least one kind of them is contained in the present invention.

Further, reduction of P and S can enhance toughness without impairing the tensile characteristics, and therefore, P and S are preferably reduced as much as possible. It is preferable from the viewpoint of enhancing the toughness to set P at 0.5% or less, and set S at 0.5% or less. In particular, P: 0.1% or less and S: 0.1% or less is preferable.

By reducing As, Sb and Sn, toughness can be improved. Therefore, the above described elements are desired to be reduced as much as possible, and As: 0.1% or less, Sb: 0.1% or less and Sn: 0.1% or less are preferable. In particular, As: 0.05% or less, Sb: 0.05% or less and Sn: 0.05% or less are preferable.

Even if the composition satisfies the above described component range, parameters A and B described below need to be simultaneously within the prescribed range in order to obtain a uniform tempered martensitic structure after aging thermal treatment. Note that the uniform tempered martensitic structure mentioned here indicates that the δ ferrite, the retained austenite and fresh martensite are respectively less than 10% in the structure.

$$(Cr+2.2Si+1.1Mo+0.6W+4.3Al+2.1Ti)-(Ni+31.2C+0.5Mn+27N+1.1Co) \quad A:$$

$$(12.5-4.0Cr-6.0Ni-3.0Mo+2.5Al-1.5W-3.5Mn-3.5Si-5.5Co-2.0Ti-221.5C-321.4N) \quad B:$$

Prescribed range: $4.0 \leq A \leq 10.0$ and $2.0 \leq B \leq 7.0$

A represents a parameter relating to stability of a martensitic structure. In order to obtain a uniform tempered martensitic structure, the parameter A is preferably from 4.0 to 10 inclusive in the component range of the steel of the present invention. The characteristics such as tensile strength reduce in accordance with formation of δ ferrite and the retained austenite, and therefore, the allowable amounts of them are set at 1.0% and 10% or less, respectively, from the viewpoint of safety. When the parameter A is less than 4.0, 10% or more of the retained austenite, and the austenite stabilization tendency is strong so that the martensitic transformation does not finish without sub-zero treatment even if the following parameter B is within the preset range. Therefore, austenite cannot be decomposed to 10% or less even by the ageing treatment at a temperature of Acl or less. Further, when the parameter A is larger than 10, 10% or more of δ ferrite forms.

B represents a parameter relating to the transformation temperature of the invention material. In order to realize the martensitic transformation finish temperature of 20° C. or higher that is a standard for obtaining a uniform tempered martensitic structure, the parameter B is preferably 2.0 or more, in the component range of the steel of the present invention.

Meanwhile, when the parameter B is larger than 7.0, the Acl temperature becomes low, 10% or more of a fresh martensitic structure which is rigid and brittle is generated at the time of ageing treatment at 500 to 600° C. that is the ageing thermal treatment temperature of the steel of the present invention, and toughness is below the target.

From the above viewpoint, by selecting the component range which satisfies the parameter A of 4.0 to 10.0 inclusive and the parameter B of 2.0 to 7.0 inclusive, an alloy having high strength, high toughness and high corrosion resistance that becomes a uniform tempered martensitic structure can be obtained.

The present invention provides a turbine rotor wherein a rotor disk section material contains, in mass, 0.10 to 0.35% of C, 0.50% or less of Si, 0.33% or less of Mn, 8.0 to 13.0% of Cr, 0.5 to 3.5% of Ni, 1.5 to 4.0% of Mo, 0.05 to 0.35% of V, 0.02 to 0.30% in total of one kind or two kinds of Nb and Ta, 0.02 to 0.15% of N, and the balance constituted of Fe and inevitable impurities, and is joined to a last stage section of the turbine rotor made of a low-alloy steel.

The present invention provides a turbine rotor wherein a disk of a low-pressure last stage is welded by a melt welding method of any one of TIG welding, submerged arc welding, and shield metal arc welding.

The present invention provides a steam turbine constituted by the above described turbine rotor, and a steam turbine power generation plant.

A blade planted portion of a rotor has to be high in tensile strength and in corrosion resistance at the same time in order to withstand use under high centrifugal stress due to high-speed rotation and under a humid environment. Therefore, a metal structure of a turbine rotor material has to be a fully tempered martensitic structure, because if harmful δ ferrite is present, the mechanical characteristics are significantly reduced.

High Cr steel for a disk used in the present invention needs to have components controlled so that a Cr equivalent calculated by the following expression:

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}+2.5\text{Ta}$$

becomes 10 or less, and needs to contain substantially no δ ferrite phase.

Tensile strength of the disk material at the turbine rotor last stage is 1000 MPa or more, and is preferably 1100 MPa or more.

The reason of the component range restriction of the turbine rotor disk material of the present invention will be described. 0.15% or more of C is needed to obtain high tensile strength. If the amount of C is made too large, the toughness and weldability are reduced, and therefore, the amount of C is set at 0.35% or less. In particular, 0.16 to 0.33% is preferable, and 0.17 to 0.30% is more preferable. Further, as a result of performing further study, it is found out that even if 0.10% of C is contained, sufficiently high tensile strength can be obtained. Therefore, the component range of C is preferably 0.11 to 0.33% in particular, and is more preferably 0.12 to 0.30%.

Si is a deoxidizer and Mn is a desulfurizing agent/deoxidizer, which are added at the time of dissolution of steel, and the effect can be obtained even by small amounts of Si and Mn. Si is a δ ferrite generating element, and addition of a large amount of Si becomes the cause of fatigue and generation of harmful δ ferrite which reduces toughness. Therefore, 0.50% or less Si is preferable. Note that according to a vacuum carburized deoxidization method, an electro-slag remelting method and the like, addition of Si is not needed, and addition of no Si is favorable. In particular, 0.10% or less is preferable, and 0.05% or less is more preferable.

Addition of a small amount of Mn enhances toughness, whereas addition of a large amount of Mn reduces toughness, and therefore, 0.33% or less is preferable. In particular, Mn is effective as a desulfurizing agent, and therefore, from the viewpoint of enhancement of toughness, 0.30% or less is preferable, 0.25% or less is preferable in particular, and 0.20% or less is more preferable.

Cr enhances corrosion resistance and tensile strength, but addition of 13% or more Cr causes generation of a δ ferrite structure. If addition of Cr is less than 8%, corrosion resistance is insufficient, and therefore, 8 to 13% Cr is preferable. Especially from the viewpoint of strength, 10.5 to 12.8% is preferable, and 11 to 12.5% is more preferable.

Mo has the effect of enhancing strength by solution strengthening and carbide/nitride precipitation strengthening action. In the case of 1.5% or less of Mo, the strength enhancing effect is insufficient, and 4% or more of Mo causes δ ferrite generation. Therefore, 1.5 to 4.0% is preferable. 1.7 to 3.5% is especially preferable, and 1.9 to 3.0% is more preferable. Note that W and Co have the effect similar to Mo, and can be contained to the equivalent contents at the upper limit for the purpose of further enhancement of strength.

V and Nb precipitate carbides and enhance tensile strength and have a toughness enhancing effect at the same time. In the case of 0.05% V and 0.02% or less of Nb, the effect thereof is insufficient, and 0.35% of V and 0.3% or less of Nb are preferable from suppression of δ ferrite formation. 0.15 to 0.30% of V is especially preferable, and 0.20 to 0.30% of V is more preferable, whereas 0.10 to 0.30 of Nb is preferable, and 0.12 to 0.22% of Nb is more preferable. In place of Nb, Ta can be added totally similarly, and in the case of combined addition, the content can be made a similar content in total.

Ni enhances low-temperature toughness, and has an effect of preventing formation of δ ferrite. This effect is insufficient with 0.5% or less of Ni, and the effect is saturated with addition exceeding 3.5%. 0.8 to 3.2% is especially preferable, and 1.0 to 3.0% is more preferable.

N has the effect of enhancing strength and prevention of formation of δ ferrite. However, with less than 0.02% N, the effect is not sufficient, and with N exceeding 0.15%, toughness and weldability are reduced. In particular, in the range of 0.04 to 0.10%, excellent characteristics are obtained.

Reduction of Si, P and S has the effect of enhancing low-temperature toughness, and Si, P and S are desirably reduced as much as possible. From the viewpoint of enhancement of low-temperature toughness, Si is set at 0.50% or less, and is preferably set at 0.1% or less, P is set at 0.015% or less, and S is preferably set at 0.015% or less. 0.05% or less of Si, 0.010% or less of P and 0.010% or less of S are especially desirable.

Reduction of Sb, Sn and As also has the effect of enhancing low-temperature toughness, and Sb, Sn and As are desired to be reduced as much as possible, but from the viewpoint of the level of the current steel manufacturing technique, Sb is limited to 0.0015% or less, Sn is limited to 0.01% or less and As is limited to 0.02% or less. In particular, 0.001% or less of Sb, 0.005% of Sn and 0.01% or less of As are desirable.

As for welding of the turbine rotor of the present invention, it is preferable that the turbine rotor is welded by any one of TIG welding, submerged arc welding, and shield metal arc welding, and post weld heat treatment is performed at 560° C. to 580° C., so that sufficient residual stress is removed, and generation of reverse transformation austenite is suppressed, whereby completely tempered martensite is applied to the disk, and tempered bainite is applied to the low-alloy rotor.

Hereinafter, examples will be described.

EXAMPLES

Example 1

Table 1 shows a chemical composition (mass%) of a precipitation hardening type martensitic stainless steel used in a long blade member. The balance is Fe. The respective samples were subjected to 150 kg vacuum arc melting, heated to 1150° C., and forged to be provided as experimental materials. As solution heat treatment, the respective samples were kept at 950° C. for one hour, and thereafter, water cooling that dips the respective samples in a room-temperature water was performed. Next, as ageing thermal treatment, the samples were kept at 500° C. for 2 hours, and thereafter, air cooling for taking the samples out into the atmosphere at a room temperature was performed.

Table 2 shows the results of a tensile test, and a V-notch Charpy impact test at a room temperature.

TABLE 1

| MATERIAL | C | Cr | Ni | Si | Mn | Al | P | S | Mo | Ti | N | A | B | (MASS %) (Al + Ti) |
|---|---|---|---|---|---|---|---|---|---|---|---|---|---|---|
| ALLOY 1 | 0.01 | 12.1 | 11.1 | 0.002 | 0.05 | 1.3 | 0.002 | 0.002 | 1.4 | 0.65 | 0.002 | 9.0 | 5.1 | 1.9 |

TABLE 2

| MATERIAL | TENSILE STRENGTH (MPa) | IMPACT ABSORPTION ENERGY (J) |
|---|---|---|
| ALLOY 1 | 1650 | 35 |

Table 3 shows a chemical composition (mass%) of a high Cr steel relating to the turbine rotor disk member, and the balance is Fe. The respective samples were respectively subjected to 150 kg vacuum arc melting, heated to 1150° C., and forged to be provided as the experimental material. After the material was heated at 1050° C. for two hours, the material was subjected to air blast cooling, the cooling temperature was kept at 150° C., and from that temperature, primary tempering was performed, in which after the material was heated at 560° C. for two hours, the material was air-cooled. Next, secondary tempering was performed in which after the material was heated at 600° C. for five hours, the material was furnace-cooled.

TABLE 3

| MATERIAL | C | Cr | Ni | Si | Mn | P | S | (MASS %) Mo | N |
|---|---|---|---|---|---|---|---|---|---|
| ROTOR | 0.12 | 11.5 | 1.5 | 0.01 | 0.25 | 0.002 | 0.002 | 1.8 | 0.03 |

From the raw material after heat treatment, a tensile test piece and a V notch Charpy impact test piece were sampled, and provided for the experiment.

Table 4 shows the results of the tensile test at a room temperature, and the V notch Charpy impact test.

TABLE 4

| MATERIAL | TENSILE STRENGTH (MPa) | IMPACT ABSORPTION ENERGY (J) |
|---|---|---|
| ROTOR | 1120 | 42 |

Both the blade material and the rotor material sufficiently satisfy the mechanical characteristics required for a large long blade.

Example 2

FIG. 1 shows an outline of a double flow type low-pressure turbine rotor. The electrode was produced by vacuum melting of the high Cr steel rotor disk components shown in example 1, the high Cr steel rotor disk components were remelted by an ESR method and a large disk of a size for an actual machine was produced. A rotor shaft was produced from a low-alloy steel specified by ASTM A470Class7. The disk section at the last stage was joined by TIG welding and submerged arc welding so that only the disk section at the last stage is of the high Cr steel, and a block construction type turbine rotor was produced. The last stage section 11 is a high Cr steel disk, an upstream side 12 is made of low-alloy steel, a shaft portion 15 is made of a low-alloy steel for the purpose of reducing a damage of the bearing portion, and a material containing 1 to 2.5% of Cr is applicable. In a welded portion 13, welding is started from an inner circumferential side, the welded portion 13 was joined by TIG welding at the initial layer through the third layer, and subsequently joined by submerged arc welding. Reference numeral 14 designates a void for weight reduction.

Figure 2:
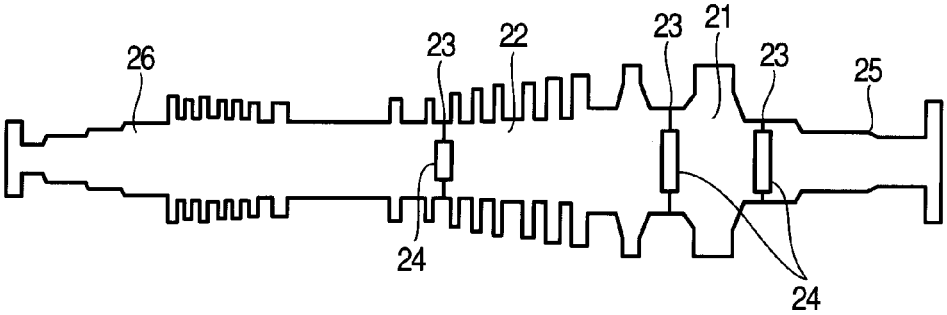
FIG. 2 is a schematic view of a block construction type high pressure-low pressure combined turbine rotor shaft.

FIG. 2 shows an outline of a single flow type high pressure-low pressure combined turbine rotor. The electrode was produced by vacuum melting of the high Cr steel rotor disk components shown in example 1, the high Cr steel rotor disk components were remelted by an ESR method and a large disk of a size for an actual machine was produced. A rotor shaft was produced from a low-pressure rotor material specified by ASTM A470Class7, and a high-pressure rotor material specified by ASTM A470Class8. The disk section at the last stage is joined by TIG welding and submerged arc welding so that the disk section at the last stage is made of the high Cr steel, to produce a block construction type turbine rotor. A final stage section 21 is a high Cr steel disk, a high-pressure section 26 is made of ASTM A470Class8, a low-pressure section 22 is made of ASTM A470Class7, and a shaft portion 25 is made of a low-alloy steel for the purpose of reducing damage of the bearing portion, and a material containing 1 to 2.5% Cr is applicable. In a welded portion 23, welding was started from an inner circumferential side, the welded portion 23 was joined by TIG welding at the initial layer thorough the third layer, and subsequently joined by submerged arc welding. Reference numeral 24 designates a void for weight reduction.

Example 3

Figure 3:
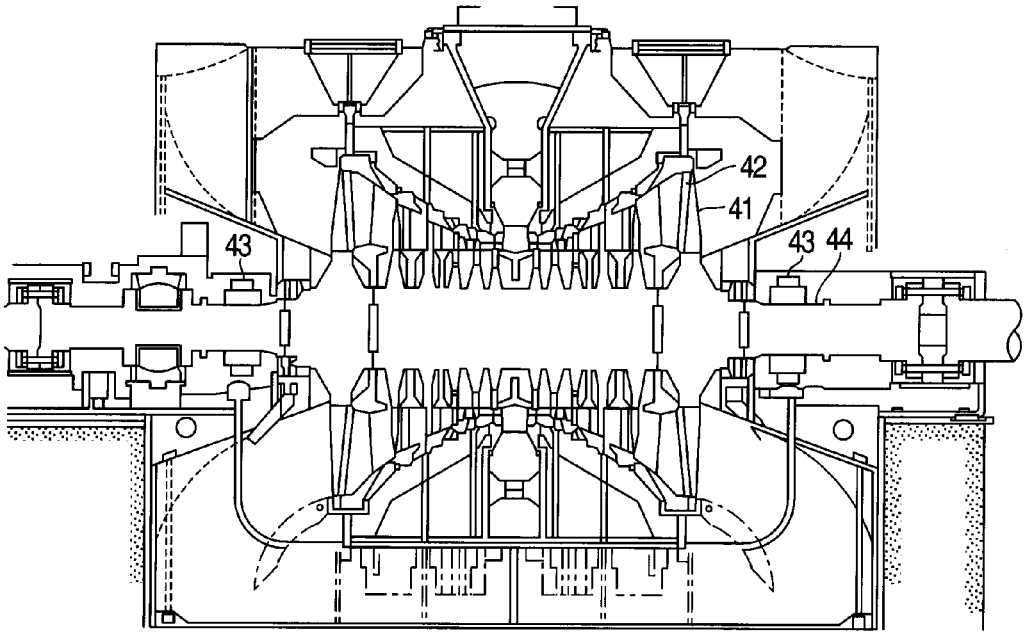
FIG. 3 is a sectional view of a low-pressure steam turbine.

FIG. 3 shows a sectional view of a low-pressure steam turbine. A rotor 44 was constituted of a low-pressure turbine rotor shown in example 2. A final stage long blade 41 was produced by closed die forging with the material composition shown in example 1.

The steam turbine rotor of the present invention can be also applied to a gas turbine compressor and the like in addition to a large steam turbine rotor, by a long blade and a rotor excellent in strength, toughness and corrosion resistance.

The invention claimed is:

1. A steam turbine rotor, comprising:

a steam turbine low-pressure final stage long blade made of a precipitation hardening type martensitic stainless steel containing, in mass, 0.1% or less of C, 0.1% or less of N, 9.0% to 14.0% inclusive of Cr, 9.0% to 14.0% inclusive of Ni, 0.5% to 2.5% inclusive of Mo, 0.5% or less of Si, 1.0% or less of Mn, 0.25% to 1.75% inclusive of Ti, 0.25% to 1.75% inclusive of Al, and the balance consisting of Fe and inevitable impurities, and a disk containing, in mass, 0.10% to 0.35% of C, 0.50% or less of Si, 0.33% or less of Mn, 8.0% to 13.0% of Cr, 0.5% to 3.5% of Ni, 1.5% to 4.0% of Mo, 0.05% to 0.35% of V, 0.02% to 0.30% in total of at least one kind of Nb and Ta, 0.02% to 0.15% of N, and the balance consisting of Fe and inevitable impurities, wherein the disk is joined to a final stage section of the stream turbine rotor made of a low-alloy steel.

2. The steam turbine rotor according to claim 1, wherein the stream turbine low-pressure final stage long blade further contains, in mass, 0.5% or less of at least one kind selected from Nb, V and Ta.

3. The steam turbine rotor according to claim 1, wherein the steam turbine low-pressure final stage long blade further contains W, and the total amount of Mo and W is the same as the amount of Mo added alone.

4. The steam turbine rotor according to claim 1, wherein the inevitable impurities of the steam turbine low-pressure final stage long blade are at least one kind selected from S, P, Sb, Sn and As, where, in mass, S: 0.5% or less, P: 0.5% or less, Sb: 0.1% or less, Sn:0.1% or less and As:0.1% or less.

5. The steam turbine rotor according to claim 1, wherein the disk of the stream turbine low-pressure final stage is welded by a melt welding method of one of TIG welding, submerged arc welding, and shield metal arc welding.

6. A steam turbine, comprising the steam turbine rotor according to claim 1.

7. A steam turbine power generation plant, comprising the steam turbine according to claim 6.

* * * * *